US005822795A

United States Patent [19]

Gold

[11] Patent Number: 5,822,795

[45] Date of Patent: Oct. 20, 1998

[54] MULTI-LAYER GLOVE CONSTRUCTIONS AND METHODS OF CONSTRUCTING MULTI-LAYER GLOVES

[76] Inventor: Danny Gold, 27 Barker Rd., Apt. E-2, Hong Kong, Hong Kong

[21] Appl. No.: 751,168

[22] Filed: Nov. 15, 1996

[51] Int. Cl.[6] ..... A41D 19/00

[52] U.S. Cl. ..... 2/159; 2/161.6; 2/169

[58] Field of Search ..... 2/159, 160, 161.6, 2/161.7, 164, 169, 167

[56] References Cited

U.S. PATENT DOCUMENTS

| | | | |
|---|---|---|---|
| 3,114,915 | 12/1963 | Gross | 2/164 |
| 4,355,424 | 10/1982 | McCoy, Jr. | 2/161.6 |
| 4,430,759 | 2/1984 | Jackrel | 2/159 |
| 4,545,841 | 10/1985 | Jackrel | 2/164 |
| 4,679,257 | 7/1987 | Town | 2/159 |
| 4,847,918 | 7/1989 | Sturm | 2/164 |
| 4,918,756 | 4/1990 | Grilliot et al. | 2/164 |
| 5,020,162 | 6/1991 | Kersten et al. | 2/164 |
| 5,483,703 | 1/1996 | Williams | 2/164 |

*Primary Examiner*—Gloria M. Hale
*Attorney, Agent, or Firm*—Aufrichtig Stein & Aufrhictig, P.C.; Peter D. Aufrichtig

[57] ABSTRACT

A multi-layer glove or mitten incorporating an inner liner, intermediate waterproof, windproof and/or breathable membrane layer and an outer shell in which the inner liner and membrane layer are secured to each other by use of an adhesive system which provides a secure fit between the layers and inhibits the reversibility of layers when the hand is removed from the glove, as well as inhibiting the movement of the crotch regions of the membrane layer from moving away from the crotch regions of the inner liner during use. The multi-layered glove is also assembled more efficiently with improved construction techniques relating to the use of the adhesive tapes secured to the outside of the inner liner layer.

8 Claims, 5 Drawing Sheets

MULTI-LAYER GLOVE CONSTRUCTIONS AND METHODS OF CONSTRUCTING MULTI-LAYER GLOVES

BACKGROUND OF THE INVENTION

The invention is generally directed to constructions of multi-layer gloves and, in particular, multi-layer gloves including waterproof, windproof and/or breathable membranes between inner liners and outer shells. The invention is also generally directed to an improved method of constructing multi-layer gloves so as to secure the waterproof, windproof and/or breathable membrane so that the layers adhere properly to the membrane layer and prevent reversing of the layers upon removal of the hands from the glove or mittens and can be rapidly and efficiently assembled.

In the past, there have been various problems associated with the constructions of multi-layer gloves, such as ski or snowboarding gloves in which a middle layer is formed of a membrane layer which is generally, waterproof, windproof and/or breathable, such as GORE-TEX®, AQUABLOC, or other commercially available membrane layers. Generally, these membrane layers are rather thin and susceptible to ripping and puncturing. In the event that the layer is punctured or even pierced by stitching, the barrier formed by this membrane layer is breached and the layer ceases to effectively act in a waterproof fashion.

A further difficulty existing in the multi-layer constructions of this sort results from the two dimensional nature of the membrane layer, which is generally formed as two flat patterns which are heat sealed around their parameter. On the contrary, the inner liner and generally, the outer shell are formed as three dimensional, pre-curved glove forms. This has the effect of mis-aligning the essentially two dimensional light membrane liner with the inner liner and outer shells of the glove, particularly at the thumb area where the insert is forced around to the palm side.

An even greater problem is the tendency of the inner liner to reverse relative to the membrane layer; particularly when the wearer's hands are sweaty and tend to adhere to the inner liner. When the inner liner reverses this causes numerous problems. First, the very thin and fragile membrane layer may tear, thereby breaking the membrane barrier and rendering the membrane layer useless. Second, even if the membrane layer does not rip, reversing the inner liner back into its intended orientation is extremely difficult, time consuming and precise work not suitable to be accomplished under the adverse conditions gloves are often worn in. Third, if the hand is then thrust back into the glove in an effort to put the reversed inner liner back into the finger stalls it is likely not to fit and would probably damage the membrane layer. Fourth, in a rush to push the inner liner into the finger stalls it is easy to get the inner liner trapped so that the glove is essentially unusable.

Various solutions in the prior art have been utilized to resolve this problem, none of which have been completely satisfactory. Use of wet and dry glues and various forms of application are common attempts to incorporate heat sensitive stripes in the fingertips. This has been tried, but these do not hold well and do not address the problem of stabilizing the two dimensional insert in proper juxtaposition to the three dimensional glove/mitt form.

Accordingly, there is a need for an improved construction and method of construction of multi-layer gloves incorporating a waterproof, windproof and/or breathable membrane layer without piercing the barrier layer formed by the membrane or securing the membrane layer to the inner liner with an adhesive at the fingertips which renders the glove and particularly the inner liner and membrane layer essentially irreversible.

SUMMARY OF THE INVENTION

It is an object of the invention to provide an improved construction for a multi-layer glove incorporating an inner liner, intermediate waterproof, windproof and/or breathable membrane layer and an outer shell in which the inner liner and membrane layer are secured to each other by use of an adhesive system which provides a secure fit between the layers and inhibits the reversibility of layers when the hand is removed from the glove, as well as inhibiting the movement of the crotch regions of the membrane layer from moving away from the crotch regions of the inner liner during use.

A further object of the invention is to provide an improved method of constructing multi-layer gloves incorporating an inner liner, intermediate waterproof, windproof and/or breathable membrane which allows for secure connection of the inner liner and membrane layer so as to improve alignment of the inner liner and membrane layer and prevent reversing of the layers upon removal of the fingers.

Still another object of the invention is to provide an improved adhesive system in which the inner liner and membrane layer of a multi-layer glove are secured to each other by use of a heat sensitive tape securely fastened to the inner liner.

Yet a further object of the invention is to provide an improved method of securing the inner liner and membrane layers of a multi-layer glove to each other by securing a heat sensitive tape to the inner liner, sliding the membrane layer over the inner liner with the heat sensitive tape and then heating the layer so as to cause the heat sensitive adhesive to bond these two layers together securely.

Still a further object of the invention to provide an improved glove construction in which an inner liner is secured to a membrane layer through the use of a series of adhesive tape panels stitched to either the back or back and front of the fingers of the liner and then heat sealed to the membrane layer to provide a secure and stable connection.

Yet still another object of the invention is to provide an improved connection between layers of a multi-layer glove in which heat sensitive tape is stitched to the back portions of the fingers of the inner liner and then heat sealed to the membrane layer which may be properly aligned and then secured in position to reduce the stress between the essentially two dimensional shape of the membrane layer and the three dimensional shape of the inner liner.

Yet still a further object of the invention is to provide an improved multi-layer glove construction which securely fastens the membrane layer to both an inner layer and an outer shell without piercing the barrier layer formed by the membrane and in a fashion which reduces the reversibility of the glove construction when the fingers are removed.

Yet a further object of the invention is to provide an improved, multi-layer sock, hat or other garment which inhibits reversing of the layers by attachment of the layers which tend to reverse with adhesive in the critical areas.

Still another object of the invention is to provide an improved method for assembling multi-layer gloves and mittens which securely fastens the membrane layer to both an inner layer and an outer shell without piercing the barrier layer formed by the membrane and which reduces the number of steps and time to assemble the multi-layer glove.

Still yet a further objected of the invention is to provide an improved method of assembling a multi-layer glove or mitten in which the inner liner is secured to the membrane layer by an adhesive which is stitched or otherwise secured to the inner liner and than heat or ultra-sonically sealed with the adhesive to the membrane layer and thereafter the outer shell is slid over the combination inner shell and membrane layer and stitched at the hem to assemble the glove.

Yet another object of the invention is to provide an improved method of assembling multi-layer gloves including at least an intermediate membrane layer in which the assemble is accomplished without the need to invert either the membrane layer or the outer shell.

Still other objects and advantages of the invention will, in part, be obvious and will, in part, be apparent from the specification.

The invention accordingly comprises the features of construction, combinations of elements and arrangements of parts which will be exemplified in the construction hereinafter set forth, and the scope of the invention will be indicated in the claims.

BRIEF DESCRIPTION OF THE DRAWINGS

For a fuller understanding of the invention, reference is had to the following descriptions taken in connection with the accompanying drawings, in which.

DETAILED DESCRIPTION OF THE PREFERRED EMBODIMENTS

Figure 1A:
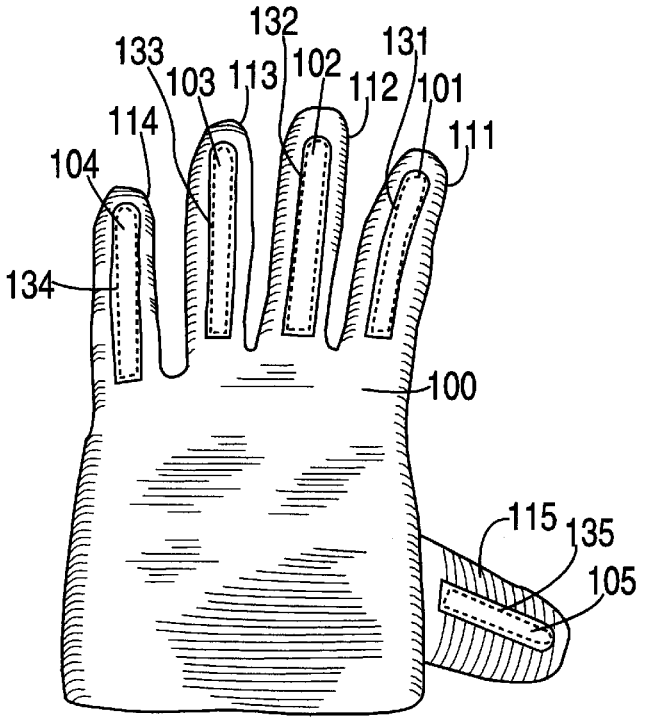
FIG. 1*a* is a partially cutaway top plan view of an inner liner of a partially assembled multi-layer glove constructed in accordance with a preferred embodiment of the invention.

Reference is first made to FIGS. 1(*a*) and 1(*b*) wherein an inner liner, generally indicated as 100 of a multi-layer glove is depicted. Inner liner 100, constructed in accordance with conventional glove making arrangements, includes finger top portions 111, 112, 113 and 114 and thumb section 115. A series of heat sensitive adhesive strips 101, 102, 103, 104 and 105 are secured to finger and thumb backs 111, 112, 113, 114 and 115 by stitching 131, 132, 133, 134 and 135, respectively. The adhesive strips 101, 102, 103, 104 and 105 are arranged so as to have a surface extending upward away from the surface of inner liner 100, adapted to adhere to a surface resting against this upper surface. In preferred embodiments, the adhesive tape may be formed having as a substrate layer (which could be a woven, knit or non-woven layer) with an adhesive, such as a polyvinyl chloride film, poly-urethane film, nylon taffeta film, nylon tricot film or other similar adhesives which can be activated by heated rollers, simple iron, fusing process, hot air or even by high frequency or ultra-sonic sound waves. Also, the tape can be made only of the adhesive itself, without any substrate layer. These tapes are of the type commonly utilized for sealing the seams in garments in garment construction.

In utilizing the adhesive tapes for sealing the seams of garments, there is great concern about the integrity of the seal formed along the seams. In the absence of a perfect seal the barrier layer usually formed by the membranes is compromised and ineffective. However, in its use as a means for securing the membrane layer 200 to inner liner 100 such perfection is not required. Rather, it is the strength of the bond, rather than its uniformity or sealing characteristics that are important. Most manufacturers of membrane layers have seam sealing adhesive tapes designed for or considered suitable for the specific membrane layer. Depending upon the needs of the adhesion, increasing amounts of tape strips can be utilized, additional area corresponding directly to increases in holding power. Even if the seal is slightly damaged or pulled by stresses in using the glove, the remainder of the seal should provide adequate holding power to prevent the glove from ultimately reversing.

FIG. 1(*b*) shows the palm surface of liner 100, shown in FIG. 1(*a*) in accordance with a second embodiment of the invention. In the first embodiment there are no adhesive strips on the palm side. In the second embodiment, adhesive strips 121, 122, 123, 124 and 125 are secured to fingers 111, 112, 113, 114 and thumb 115 by stitching 141, 142, 143, 144 and 145, respectively. The heat adhesive strips shown in FIG. 1(*b*) are like the heat adhesive strips shown in FIG. 1(*a*) and may be utilized where there is a substantial need for retaining the membrane shell which will surround the inner liner in place and prevent reversing of the membrane layer and inner liner during removal of the fingers from the glove. In many situations the inner liner 100 need only have the panels 101, 102, 103, 104, 105 on the back of the finger stalls 111, 112, 113, 114, 115 rather than also on the palm side as shown in FIG. 1(*b*).

Thus, in one embodiment, the palm of inner liner 100 has no adhesive strips. This sort of an arrangement may be adequate for general skiing and less vigorous sporting environments in which the wearer's hands are less likely to sweat as much, which has the effect of increasing the difficulty of removing the fingers from the glove and increasing the likelihood of the inner liner and membrane layer from reversing. In more intensive sports, such as mountain climbing, cross-country running, winter biking or other similar sports where sweat is a major problem, more adhesive control points, such as the adhesive strips shown in FIG. 1(*b*) can be utilized. The adhesive strips on the back of the fingers and thumb tend not to interfere in any way with the flexibility of the glove in use or with the feel when gripping an object such as a ski pole. When adhesive strips are added to the palm side of the fingers and thumb an increased holding potential is created but there may be a consequent diminution in flexibility and loss of feel.

Placing the adhesive on the back of the finger stalls or the front of the finger stalls is better than the sides. While the sides can be used, the flexing of the fingers may have a tendency to cause the bond to break as the creasing and uncreasing with each flex of the fingers is more severe. In a mitten construction it may be preferable to use one larger piece for the finger stalls rather than several strips. This larger piece would be used in addition to the strip on the thumb stall.

Figure 1B:
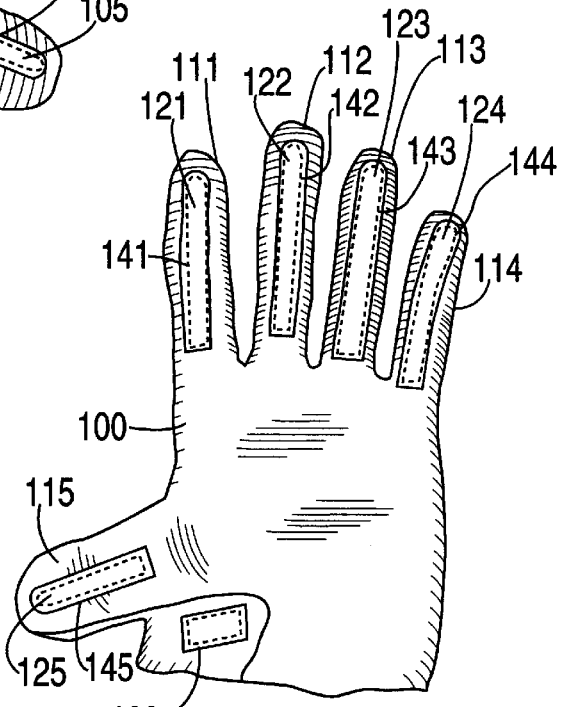
FIG. 1*b* is a partial, top plan view of the back of an inner liner for use in multi-layer glove constructed in accordance with a preferred embodiment of the invention.

In addition, as shown in FIG. 1*b,* a thumb aligned adhesive patch 160 may be used to align the two-dimensional thumb to the three dimensional glove by controlling the position of the thumb with an adhesive pad. One avoids another problem of inserts in which the thumb twists and doesn't fall properly in the seams of the lining or glove shell. This patch 160 may be used with the strips on the back of each of the fingers only or with both back and front surfaces.

Figure 2B:
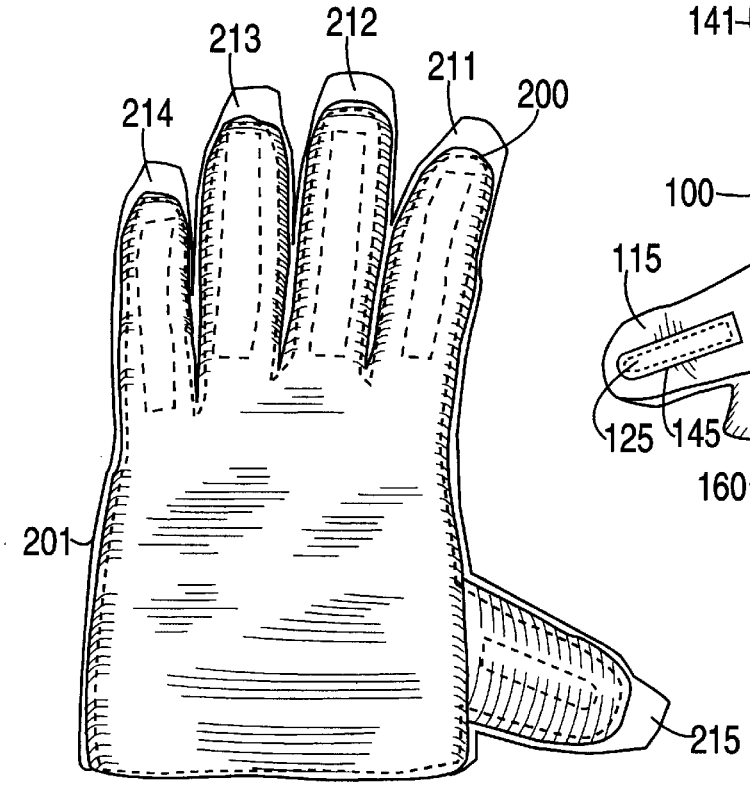
FIG. 2*b* is a top plan view of a partial glove construction in which a membrane layer has been slid over the inner liner in accordance with another preferred embodiment of the invention.
Figure 2A:
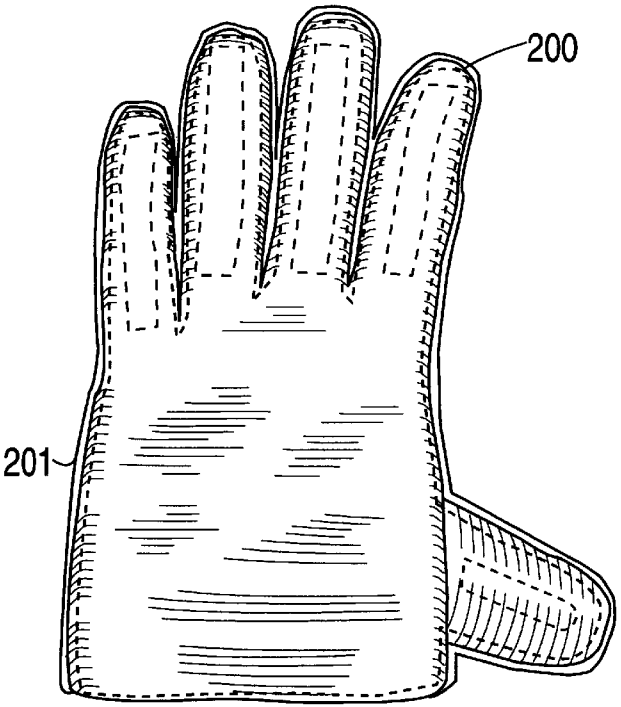
FIG. 2*a* is a top plan view of a partial glove construction in which a membrane layer has been slid over the inner liner in accordance with a preferred embodiment of the invention.

Reference is next made to FIG. 2*a* wherein a membrane layer 200 having a heat seal 201 about its parameter is slid over inner liner 100 with adhesive strips 101, 102, 103, 104 and 105 (and in the embodiment where there are adhesive strips on the palm portion, such as shown in FIG. 1(*b*), these adhesive strips as well). Membrane layer 200 is a two piece membrane layer glove and is generally formed of a waterproof, windproof and/or breathable layer such as AQUAGUARD™, WINDGUARD™ or GORTEX®. The two sections of membrane layer 200 are joined to each other about the periphery where a heat seal 201 is formed to create a barrier layer only broken at the open end of the glove into which the hand is inserted.

It is important to note that inner liner 100 is formed, generally, as a three dimensional glove structure in accordance with modern glove technology so that the inner liner 100 more comfortably fits and moves with the wearer's hand. Indeed, in preferred embodiments inner liner 100 is formed in a pre-curved fashion, again in accordance with conventional modern glove construction, so as to ease the stress on the wearer's hand when in a resting position. When a person's hand is at rest, the fingers are in a gently, inwardly curved condition rather than with the fingers extending straight out. Thus, in better quality gloves, the three dimensional inner liner glove is formed so as to have a gently pre-curved shape which fits more comfortably on the wearer's hand.

Unfortunately, the two-dimensional nature of the membrane layer 200 tends to create problems in the fit and adherence of membrane layer 200 to inner liner 100. This misalignment exists due to the general incompatibility of a two-dimensional glove shape and the more natural three-dimensional glove shape of the inner liner 100. This tends to create a greater stress in certain areas, such as the thumb stall and the fingers, which, in a sweaty glove heightens the likelihood of the inner shell being pulled out of the membrane layer (or reversing), as the wearer's hand is removed from the glove. By concentrating the adhering power of the adhesive tapes on the finger regions, where the greatest stresses are found, two significant structural benefits are achieved. First, the outer membrane layer may be carefully aligned with the inner shell so as to reduce the inherent stresses relating to the misalignment, which would be greater if only the fingertip regions of the inner liner and membrane layer were secured.

In contrast to the prior art approaches, the irreversible system described herein applies the holding power of the adhesive strips in the fingers where the tendency to reverse is the strongest and the bond is greater. The membrane layers are usually fragile and holding the members at the tips does not give adequate protection, particularly between the inner liner and the membrane layer. The adhesive tips will hold to a limited extent, but constant use will break the seal and/or destroy the waterproof integrity of the membrane. In those prior art constructions, in which the membrane layer is sewn to the inner liner and then reversed over the inner liner, the stress on the heat sealed insert is great and tends to damage the membrane layer.

Next, following the insertion of the membrane layer over inner liner 100 and alignment of the two glove layers relative to each other, the heat adhesive is activated, by use of the pressure of rollers and heat supplied either by the rollers or by a current of hot air. Alternatively, ultrasonic or high frequency sound waves may be used to activate the adhesive. The adhesive is adapted to form a solid bond with the membrane layer. Various manufacturers of membrane layers indicate preferred adhesive tapes for use with their products. Depending upon the type and brand of membrane layer utilized suitable adhesive tapes can be utilized. Through analysis of the stresses related to the intended uses of the glove or mitten, adjustments to the locations and sizes of the adhesive tape strips can be suitably made.

When the heat adhesive is activated by the use of heat as indicated above, the inner liner 100 and membrane layer 200 are securely fastened to each other in the regions of the fingers 111, 112, 113, 114 and 115 so that when the wearer's hand is removed from the glove during use, even where the hand is sweaty which causes it to stick to inner liner 100, the two layers will resist reversing. In addition, the stress when the hand is removed in this sweaty condition, is not placed at the heat seal 201 in membrane layer 200.

Many of the prior art approaches to securing an inner liner to a membrane layer in a multi-layered glove utilized tabbed or stitching or similar contrivances at the tips of the fingers. This has the effect of decreasing the effectiveness of the securing mechanism as a means to prevent reversing of the two layers, and also increases the stress on the fragile heat seal 201 around the parameter of membrane layer 200. By extending the adhesive along the lengths of the fingers an enlarged area of contact distributes the pressures over a greater area, away from the fragile heat seal 201, and thus distributes the pressure so as to minimize the risk of ripping or tearing the fragile membrane layer.

Figure 7:
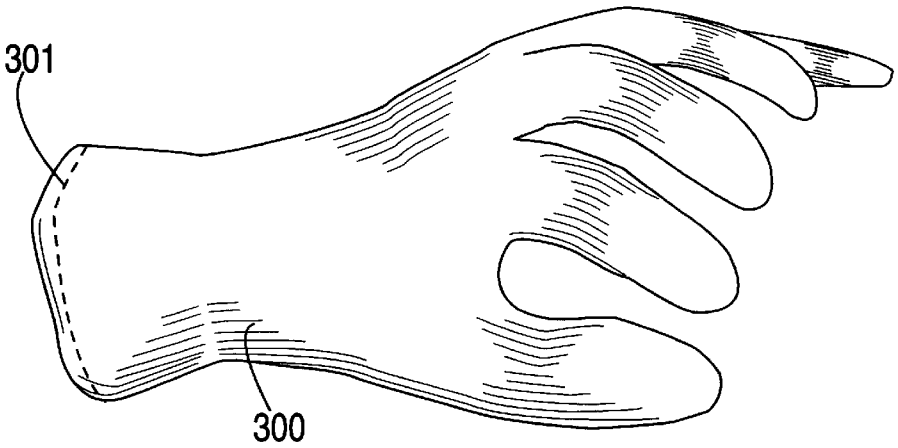
FIG. 7 is a perspective view of an assembled glove constructed in accordance with a preferred embodiment of the invention.

Following the heat sealing of the adhesive strips to the membrane layer and outer shell layer 300, outer shell layer 300 is pulled over the heat sealed inner liner and membrane layers to form multi-layer glove (FIG. 7). Rather than requiring reversal or inversion of the outer glove, the outer glove merely instead slips into its finished position over the other two layers. This is contrasted with many of the prior art glove constructions in which the outer shell must be inverted, in some fashion secured to the inner layers, and then reversed again into its final condition, requiring substantial time, effort and then re-ironing to eliminate the wrinkles and unevenness introduced by the inversion of the shell and re-inversion over the insert/lining combination.

In practice, glove sections, such as outer shell layer 300, are sewn in an inside out orientation so that the seams will be hidden on the inside of the glove in its finished form. However, once the seams are completed the glove layer must be inverted to its final state and then ironed and inspected to determine if there are any imperfections in the sewing, known in the trade as "menders". This must be done prior to the glove being hemmed, which then makes repair considerably more difficult. However, if the outer shell is to be inverted yet again to be attached to the combination of the membrane layer and inner liner, it is necessary, to maintain quality control, to first invert the glove to its final state and iron it to look for menders, and then re-invert the glove for attachment to the inner liner/membrane components and then re-invert the glove and re-iron it following assembly.

Thereafter, the outer shell is secured to the inner liner/membrane layer combination by stitching around the wrist or gauntlet of the glove at the hem by stitching around the glove with seam 301 (FIG. 7). The stitching around the hem at the wrist or gauntlet region of the glove may extend through the membrane layer as a breach of the membrane layer at this point proximate the hand opening does not adversely impact the operation of the glove or mitten. In addition, it is generally unnecessary to have any additional attachment of the outer shell to the combination inner liner and membrane layer beyond the stitching at the hem or gauntlet. This is due to the reversing problem being caused primarily by a susceptibility of the membrane layer and inner liner to invert when the hand is removed from the glove. A much smaller concern and problem exists with respect to the combination inner liner and membrane layers reversing with respect to the outer shell.

Figure 8:
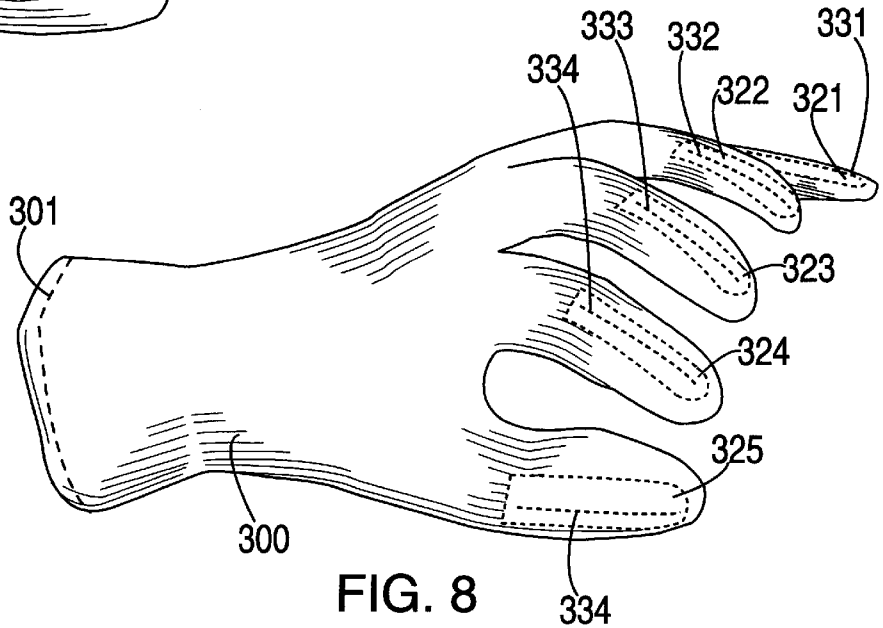
FIG. 8 is a perspective view of an assembled glove constructed in accordance with another preferred embodiment of the invention.

An approach, shown in FIG. 8, is to stitch adhesive strips 321, 322, 323, 324 and 325 to the inner surface of outer shell 300 prior to assembly with stitches 331, 332, 333, 334, 335, either in the palm or back regions of the backs of fingers, and then following the placement of outer shell 300 over membrane layer 200, heat or ultrasonic pulses may be applied to the glove to secure the outer shell to the outside of membrane layer 200. This approach benefits from the absence of the need to invert outer shell 300 as would be required in sewing the fingertips to the tabs extending from membrane layer 200. In practice, the adhesive strips are easily attached to the insides of the outer shell panels before it is assembled. This is then an easy attachment to a flat member.

Figure 5:
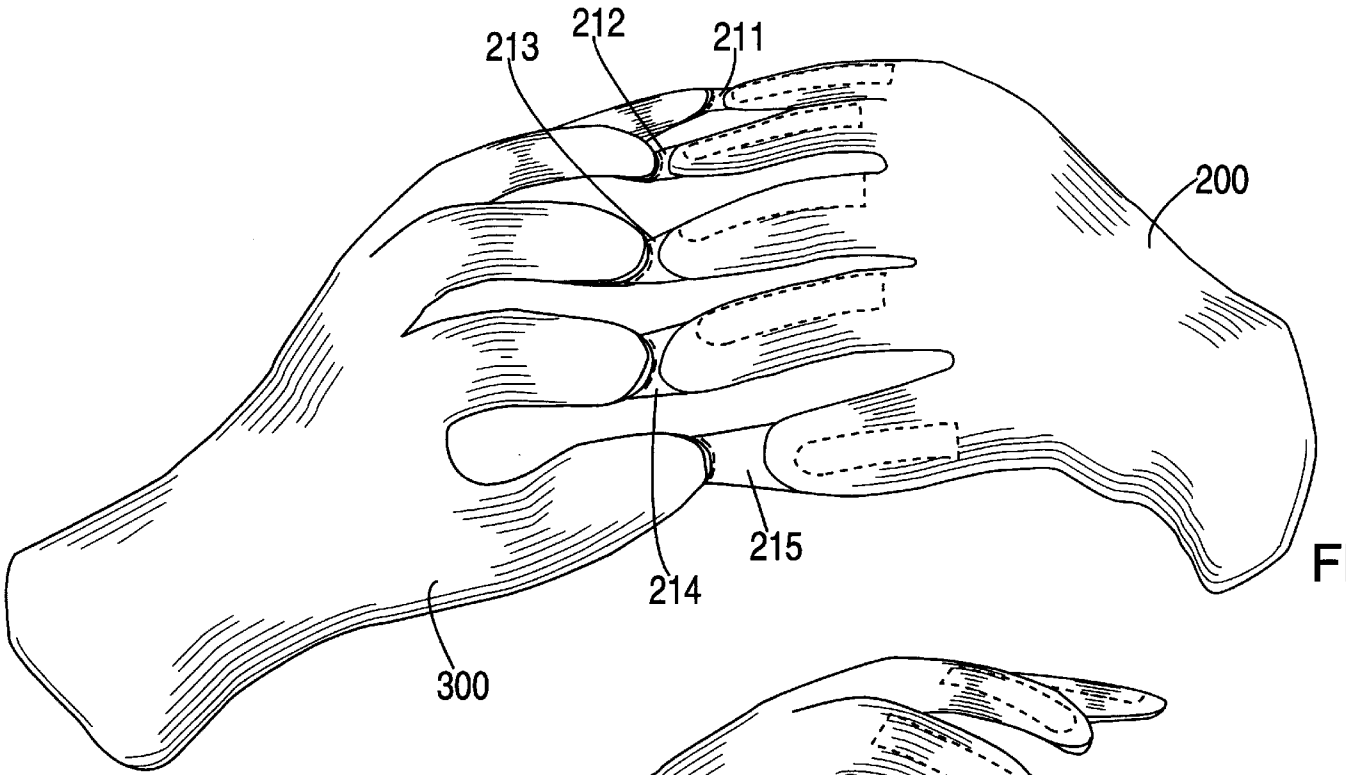
FIG. 5 is a partially assembled multi-layer glove construction in accordance with a another preferred embodiment of the invention.
Figure 6:
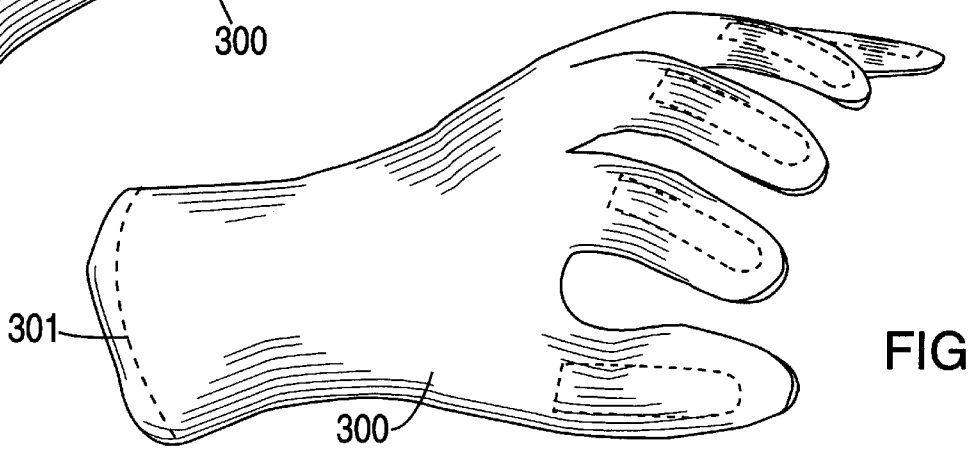
FIG. 6 is the glove of FIG. 5 in an assembled state.

In some circumstances, it may be desirable to have a greater connection between the outer shell and the inner liner/membrane layer component. Reference is made to FIG. 2*b* in which the membrane layer has tab regions 211, 212, 213, 214 and 215 extending outwardly from the fingers and thumb outside of the heat seal 201. Outer shell 300 can be assembled in two different ways associated with this construction. Either, it can be slid over in its finished orientation and then stitched through the fingertips of the finished shell, extending through the tab regions 211, 212, 213, 214 and 215 or, as shown in FIG. 5, the tab regions may be stitched to the inside of the finger tips of outer shell 300. Thereafter, outer shell 300 is then inverted so as to have its outside surface on the outside as shown in FIG. 6, over membrane layer 200. While this approach is not preferred, as it requires the additional inversion of the outer shell, it may also be utilized.

FIG. 6 shows the finished glove of FIG. 5 and also includes a stitching 301 along the hem portion of the glove to retain the layers together.

The attachment of the various layers to each other has been shown with reference to a glove. The same structure and method and method of construction and assembly techniques can be properly utilized in connection with mittens, as described above, as well as in other garments that are put on and taken off repeatedly, such as socks, hats, boots and other similar articles of clothing and the like.

Figure 3:
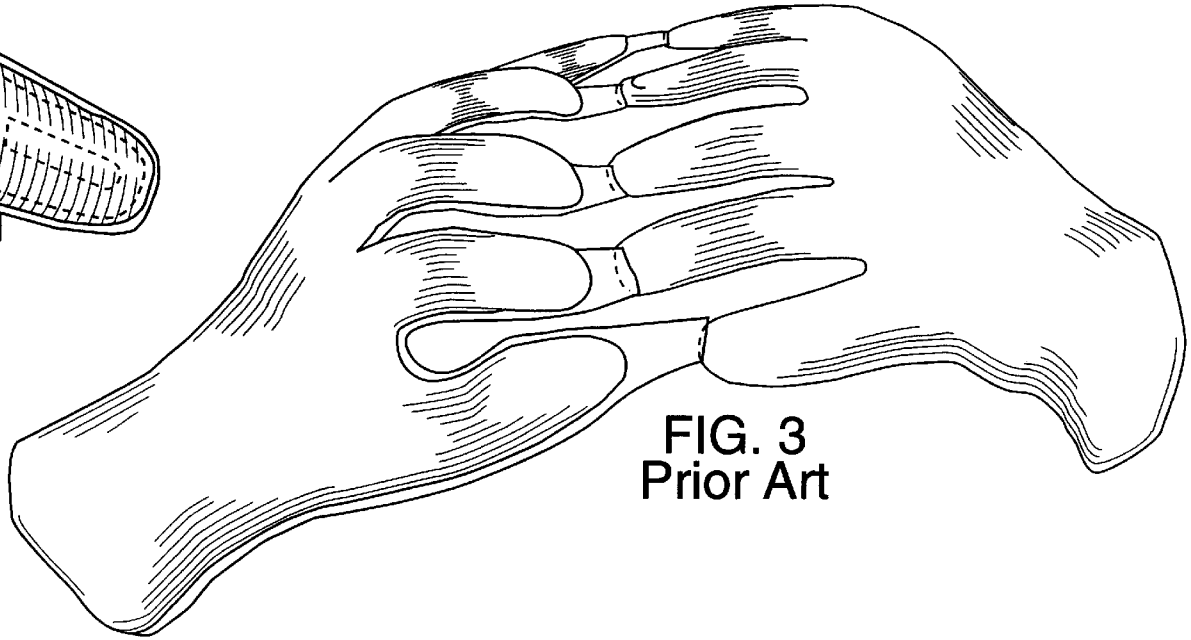
FIG. 3 Prior Art
FIG. 3 is a perspective view of a partially assembled glove constructed in accordance with the prior art.
Figure 4:
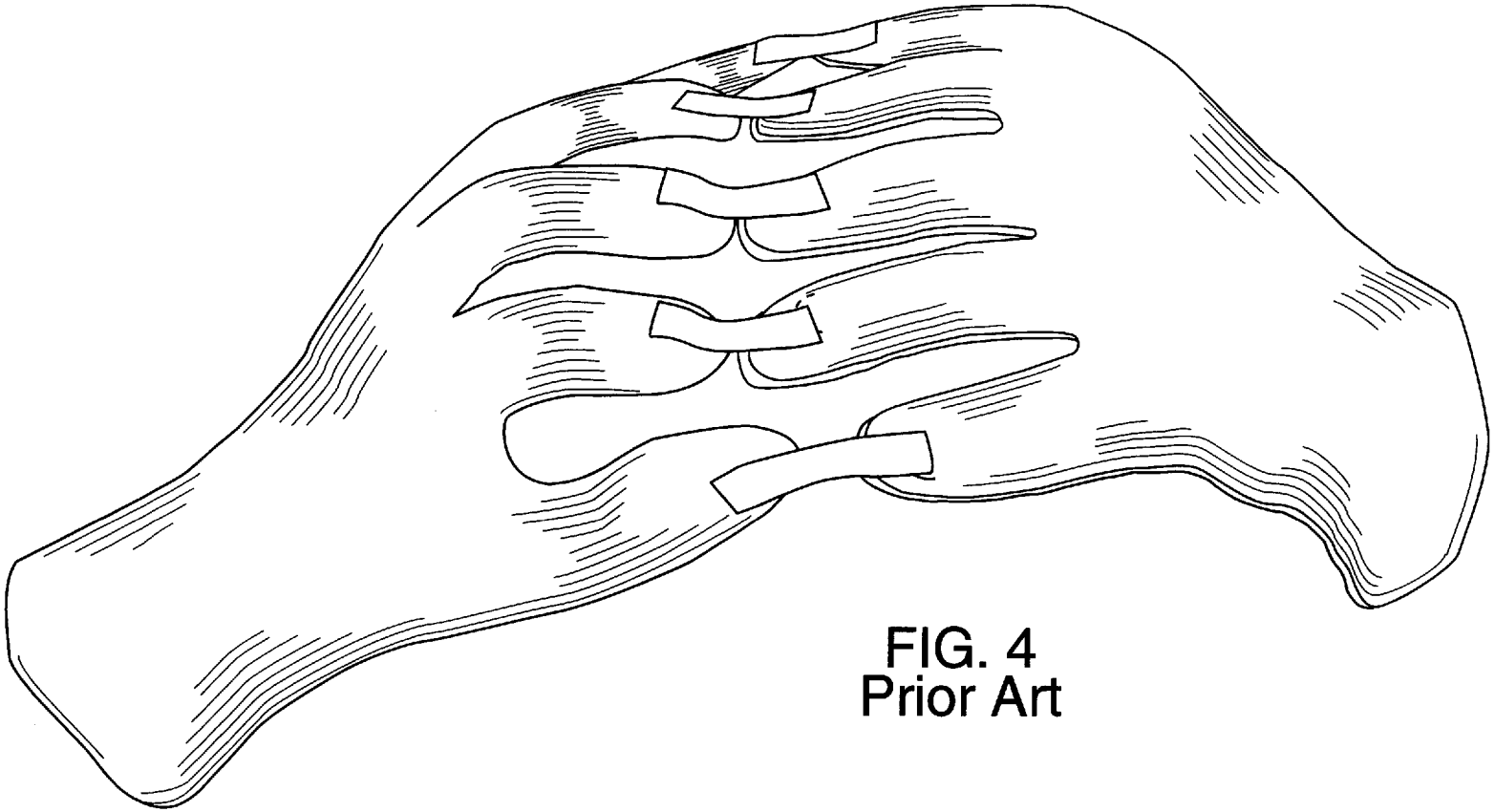
FIG. 4 Prior Art
FIG. 4 is a perspective view of a multi-layer glove constructed in accordance with a the prior art.

The prior art multi-layer gloves, such as the Ragan U.S. Pat. No. 5,349,705 wherein a multi-layer glove having an intermediate membrane layer are less efficiently and effectively constructed. The Ragan construction starts with an inner liner and a two-dimensional membrane layer. The membrane layer is sewn to the tips of the outside of the inner liner at portions outside the heat seal. This prior art construction is shown in FIG. 3. Thereafter, the membrane layer is inverted over the inner liner and then through the use of an adhesive tape, the fingertips of the outer shell (in an inverted orientation) and the membrane layer are secured. This arrangement is shown in FIG. 4. Finally, the outer shell is again reversed over the inner liner/membrane layer to create a finished glove. This construction, in addition to suffering from the structural problems associated with this construction as described above, is also considerably less efficient and time-consuming to assemble.

Applicant conducted a time analysis of the construction process disclosed herein and that disclosed in the Ragan patent to highlight the substantial advantages present in the current structure and assembly approached. The study was conducted to identify the minutes per dozen gloves per operation so that the time required to complete a dozen gloves is shown. First, the time is shown in connection with the construction in accordance with the embodiment of FIG. 1 in which the adhesive tape is only placed on the backs of the fingers and then for the Ragan construction.

| | MIN/DZ/OPERATION |
|---|---|
| 1. FIGURE ONE ASSEMBLY | |
| (a) Stitching adhesive to lining on five fingers | 34.00 |
| (b) Inserting inner lining in membrane layer | 16.27 |
| (c) Heat sealing | 6.40 |
| (d) Inserting shell onto membrane/inner liner combination | 17.14 |
| Total Assembly Time | 73.81 |
| 2. RAGAN - U.S. Pat. No. 5,349,705 | |
| (a) Stitching insert tabs to inner lining | 32.00 |
| (b) Inverting membrane insert onto lining | 32.54 |
| (c) Sealing tabs on each finger of the inverted insert/lining combination | 82.76 |
| (d) Stitching tabs to glove outer shells | 32.73 |
| (e) Inverting shell onto insert/lining combination | 19.20 |
| Total Assembly Time | 199.23 |

Clearly, the advantages of this method are substantial. In addition to the pure time advantages and the consequent cost savings associated therewith, the level of skill of the operators need not be as high as with the Ragan constructions. In addition, there are also the structural benefits noted above with respect to the enhanced resistance to reversibility of the new glove structure.

Accordingly, an improved multi-layer glove and method of production of such gloves which improves the speed with which the gloves can be assembled, improves the resistance to the reversibility of the inner liners and the membrane layer are provided.

It will thus be seen that the objects set forth above, among those made apparent in the preceding description, are efficiently obtained and, since certain changes may be made in the above constructions without departing from the spirit and scope of the invention, it is intended that all matter contained in the above description or shown in the accompanying drawings shall be interpreted as illustrative, and not in a limiting sense.

It is also to be understood that the following claims are intended to cover all of the generic and specific features of the invention, herein described and all statements of the scope of the invention which, as a matter of language, might be said to fall therebetween.

What is claimed is:

1. A multi-layer glove, comprising:

an inner liner layer having an inner surface and an outer surface, the inner surface being adapted to contact a wearer's hand;

a waterproof and breathable membrane layer sized so as to fit over the inner liner layer, having an inner and outer surface;

an outer shell member sized so as to fit over the waterproof and breathable membrane layer; the inner liner, waterproof and breathable membrane layer and outer shell forming a multi-layer glove; and at least two adhesive strips secured to the outer surface of the inner liner layer, proximate backs of the fingers and thumb, with the adhesive bonded to the inner surface of the membrane layer, the outer shell member secured to the inner liner and membrane layer proximate the open end of the glove; and whereby a multi-layer glove incorporating a waterproof and breathable membrane is provided which prevents the waterproof and breathable membrane from reversing as the wearer removes the glove from his or her fingers.

2. The glove of claim 1 wherein each of the adhesive strips is secured by a row of stitches proximate the backs of the fingers of the glove or mitten.

3. The glove of claim 1 wherein the waterproof and breathable membrane layer is formed of two panels of waterproof and breathable membrane sealed around the periphery of the panels.

4. The glove of claim 1 wherein there are adhesive strips secured to each of the backs of the fingers and thumb of the inner liner by stitching.

5. The glove of claim 4 further including adhesive strips secured to the palm sides of each of the fingers and thumb by stitching.

6. The multi-layer glove of claim 1 wherein the outer shell, membrane layer and inner liner are secured to each other by a seam running about the open end of the glove and extending through each of the three layers.

7. The glove of claim 3 wherein the waterproof and breathable membrane layer has extended fingertip portions extending beyond the seal around the periphery of the panels in the regions around the fingers and thumb and the outer shell member is secured to the membrane layer by stitching extending through fingertip portions of the outer shell member and the extended portions of the membrane layer.

8. The glove of claim 1 further including an adhesive pad secured to the outer surface of the inner liner layer proximate the base of the thumb on the palm side of the outer surface of the inner liner layer.

* * * * *